United States Patent [19]

Heck

[11] 4,261,103

[45] Apr. 14, 1981

[54] TOOL ACCESSORY APPARATUS

[75] Inventor: Bennett L. Heck, Cook County, Ill.

[73] Assignee: Hex International, Inc., Chicago, Ill.

[21] Appl. No.: 73,187

[22] Filed: Sep. 7, 1979

[51] Int. Cl.[3] ..... B26B 1/00

[52] U.S. Cl. ..... 30/159; 7/118

[58] Field of Search ..... 30/159, 162; 7/118, 7/162

[56] References Cited

U.S. PATENT DOCUMENTS

| | | | |
|---|---|---|---|
| 592,612 | 10/1897 | Johnson | 30/159 |
| 1,087,788 | 2/1914 | Larsen | 30/159 |
| 1,584,165 | 5/1926 | Brown | 30/159 |
| 2,575,652 | 11/1951 | Bovee | 7/118 X |
| 2,749,924 | 6/1956 | Polincovsky | 30/162 X |
| 2,808,646 | 10/1957 | Lohr | 30/159 |
| 2,896,576 | 7/1959 | Baer | 7/118 X |

*Primary Examiner*—Jimmy C. Peters

*Attorney, Agent, or Firm*—Wagner & Aubel

[57] ABSTRACT

A tool accessory having an extensible operative portion which may be stored in a handle portion when not in use. The operative portion is pivotally attached to one end of the handle portion to allow the operative portion to pivot from a fully open position to the closed position. The operative portion may be ejected from the closed handle position in the same manner as a switchblade knife, and may take the form of different items, such as a pen, scissors, a nail file or a pair of tweezers.

8 Claims, 13 Drawing Figures

FIG. 8
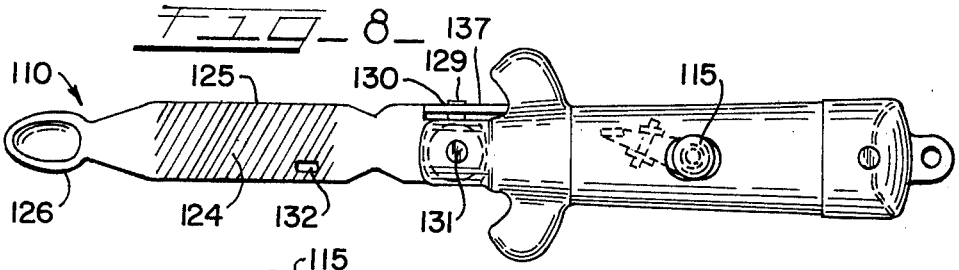
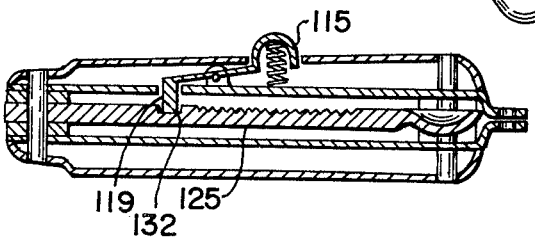
FIG. 9
FIG. 10
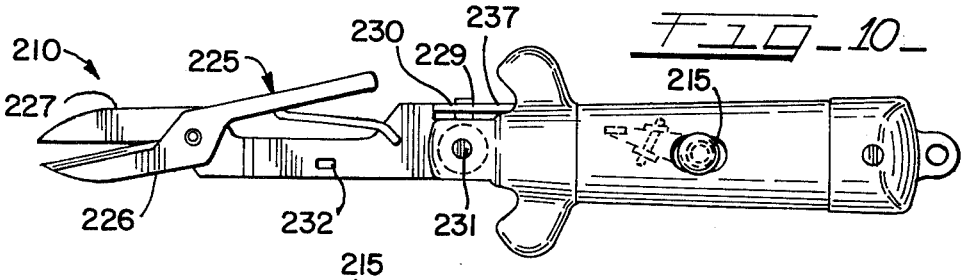
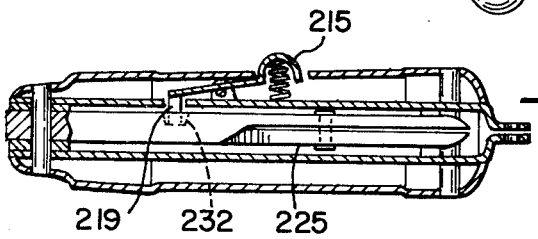
FIG. 11
FIG. 12
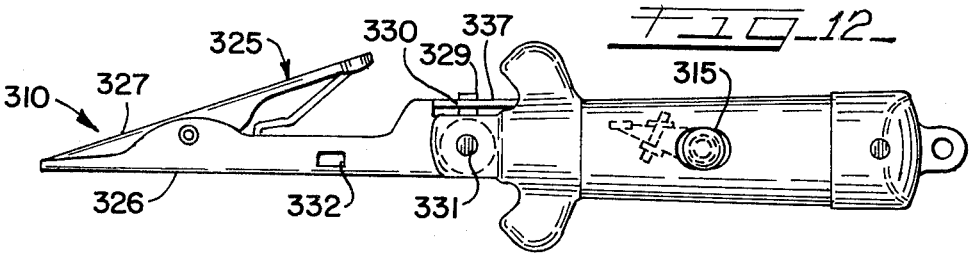
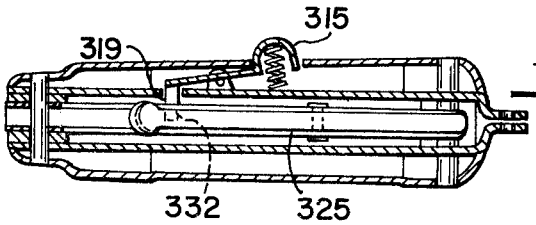
FIG. 13

TOOL ACCESSORY APPARATUS

BACKGROUND OF THE INVENTION

This application relates to tool accessories and more particularly, to a switchblade type apparatus for housing such tool accessories.

Various forms of pens have been available in the market place utilizing different mechanisms for covering or hiding the writing tip of the pen so that the pen may be placed in a pocket or the like without fear of causing inadvertant marking damage to clothing or whatever storage compartment it may be placed in. Such mechanisms have included disappearing tips and other functional means for covering the writing tip. In addition, because of the nature of their sharp tips, items such as scissors, tweezers and the like have been found inappropriate to be carried by user, due to a fear of tearing one's clothes.

SUMMARY OF THE INVENTION

The subject invention comprises a pocket item which, in the closed position closely resembles a pocket knife. The interior of the apparatus houses a handle portion and an operative portion. The operative portion, for instance in a pen, has a writing tip which is lockable in an extended position and yet pivotally connected to the handle portion. Thus, the operative portion might be folded to a closed position in a recess within the handle. In addition, the operative portion is spring-loaded within the handle, in the manner of a switchblade knife so that at the release of the locking mechanism, the operative portion will spring open and allow the user to secure it in the open position. Thus, in the embodiment utilizing a pen, the writing tip will be pivotal to the open position. Other embodiments for utilizing a nail file, tweezers and scissors are described. The subject invention, therefore, comprises an object which may, for example, be attached to a key chain, and, besides being ornamental, also serve a useful function. As the operative and sharp portion of the device is safely covered in the closed position, no dangers to person or clothing are present.

Therefore, an object of the subject invention is a tool accessory capable of adoption to different tools.

Yet another object of the subject invention, is a pen which may be easily secured to cover the writing portion to enable it to be carried in a pocket or the like without worry of marking problems.

A further object of the subject invention, is a pen which may operate in the nature of a switchblade knife to place the pen in condition for writing.

Yet another object of the subject invention is a nail file which may operate in the nature of a switchblade knife to place the nail file in condition for use and storage.

Still another object of the subject invention is a pair of scissors which may operate in the nature of a switchblade knife to place the scissors in condition for use and storage.

A still further object of the subject invention is a pair of tweezers which may operate in the nature of a switchblade knife to place the tweezers in condition for use and storage.

DESCRIPTION OF THE DRAWINGS

Further objects of the invention together with additional features contributing thereto and advantages accruing therefrom will be apparent from the following description of one embodiment of the invention when read in conjunction with the accompanying drawings wherein:

FIG. 8 is a top plan view of another embodiment of the subject invention showing a nail file in the open position.

FIG. 9 is a cross-sectional view of the embodiment of FIG. 8 showing the nail file apparatus in the closed position.

FIG. 10 is a top plan view of another embodiment of the subject invention showing a pair of scissors in the open position.

FIG. 11 is a cross-sectional view of the embodiment of FIG. 10 showing a pair of scissors in the closed position.

FIG. 12 is a top plan view of another embodiment of of the subject invention showing a tweezers in the open position.

FIG. 13 is a cross-sectional view of the embodiment of FIG. 12 showing the tweezers in the closed position.

Referring now to FIG. 1 there is shown the pen apparatus 10 as one embodiment of the subject invention in the folded, or closed position. As such, the writing implement portion 25 is enclosed within the interior 20 of the pen body. The pen will be described in detail; it should be understood that the nail file, scissors and tweezers embodiments, though not described in as great detail have substantially the same structure and function and operate in the same manner.

Figure 1:
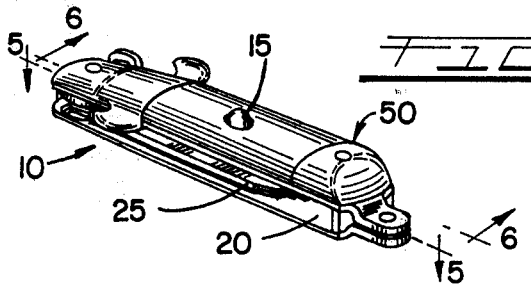
FIG. 1 is a perspective drawing of one embodiment of the subject invention showing a pen apparatus in the closed position.
Figure 2:
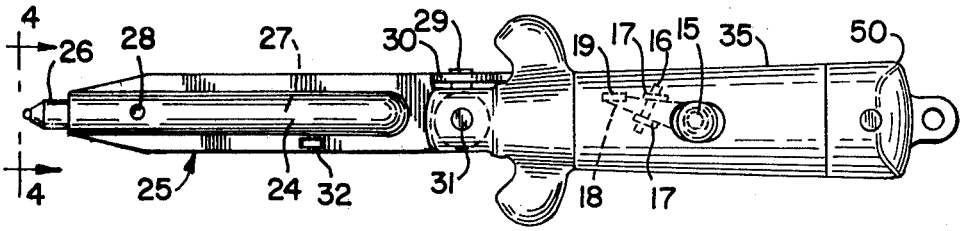
FIG. 2 is a top plan view of the pen apparatus of FIG. 1 showing the writing implement in the extended writing position.
Figure 3:
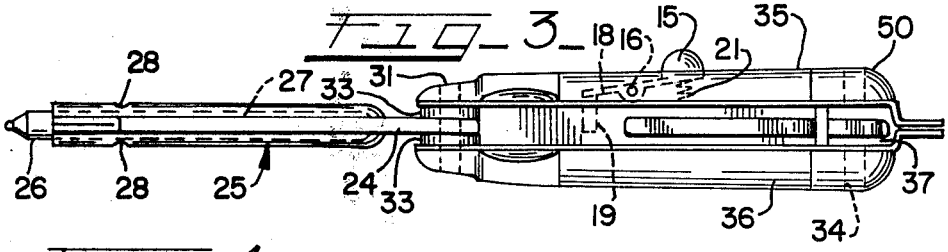
FIG. 3 is a side plane view of the pen apparatus of FIG. 1, also showing the writing implement in the extended writing position.
Figure 4:
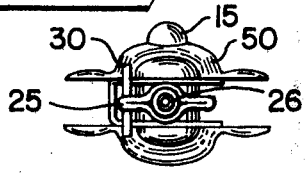
FIG. 4 is a side plan view of the pen apparatus of FIG. 1 taken along the lines 4—4 of FIG. 2.
Figure 6:
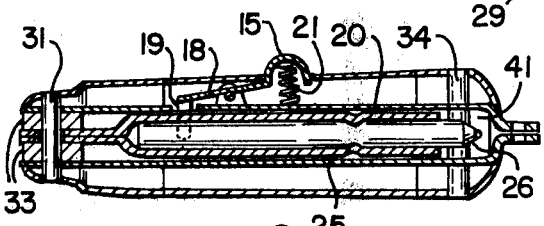
FIG. 6 is a cross-sectional view of the pen apparatus of FIG. 1 taken along the lines 6—6 of FIG. 1 showing the interior of the handle assembly of the novelty pen apparatus in the closed position.
Figure 7:
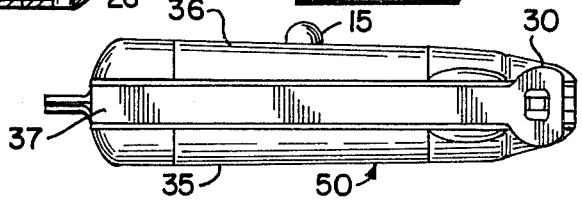
FIG. 7 is a side plan view of the pen apparatus of FIG. 1 showing the means for retaining the writing implement in the open position.

The novelty pen of the subject invention is shown in the open position in FIGS. 2 and 3, where it can be seen that the writing implement portion 25 comprises a ballpoint pen having a writing tip 26 and an ink reservoir 27, as generally known in the art. The ink reservoir 27 and pen tip 26 is partially encased within a pen body stamped out of sheet metal and secured by opposing dimples 28. When in the open position as shown in FIGS. 2 and 3, the user will grasp the writing portion 25 along its length between thumb and forefinger and write in a normal fashion. The writing implement portion 25 is pivotally secured to the handle portion 50. The handle portion 50 comprises an elongated member secured at opposing ends in parallel by rivets or other appropriate fastening means 31 and 34. The elongated members 35 and 36 are spaced from one another by spacers 33 and 41 thereby creating an opening or recess 20 between the elongated handle members 35 and 36 (FIG. 6). A backplate 37 of limited resiliency is secured between the handle members 35 and 36 terminates in a locking means 30 for holding the pen in the open position as will be described later.

Figure 5:
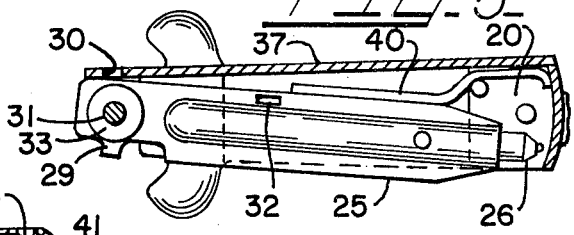
FIG. 5 is a cross-sectional view of the pen apparatus of FIG. 1 taken along the lines 5—5 of FIG. 1 showing the interior of the handle assembly of the subject invention in the closed position.

The writing implement portion 25 is secured to the handle portion 50 in a pivotal fashion about a rivet or pin 31 between a pair of spacers 33. In this manner the writing implement 25 may be pivoted from an open position (FIG. 2) into a closed position with the handle opening 20 as shown in FIG. 5. A tab 29 is formed in the pen holder 24, preferably adjacent the axis or rivet 31 about which the writing implement 25 pivots. When the writing utensil portion 25 is swung into the open position, the tab 29 is secured by locking means or latch 30, which comprises an opening on backplate 37. As a result of the backplate's limited resiliency, latch 30 may be released by lifting the backplate 37 up and over tab 29. In the locked position, the latch 30 exerts a continual pressure or bias against tab 29, locking the writing utensil in an open position (FIG. 2).

Upon lifting the latch 30 and allowing tab 29 to disengage with the latch 30, the writing utensil portion 25 may be pivoted into a closed position. Writing utensil portion 25 is retained in the closed position by the insertion of tab 19 into an opening 32 on pen retainer body 34. Tab 19 is secured at one end of arm 18, which is pivotal about a central portion. Arm 18 has an actuator button 15 on an end portion opposite the tab 19. The actuator button 15 is retained in the locking position (up) by the biasing action of coil spring 21 on the underside of the actuator button 15. Arm 18 rocks about a pivot pin 16 secured to its midsection between a pair of ears 17 formed integrally with the handle member 35. Thus, on the manual depression of the actuator button 15 against the bias of spring 21, tab 19 is lifted out of opening 32 and the writing utensil portion 25 is ejected from the interior compartment 20 by a length of spring metal 40 which is secured in the interior of compartment 20 and is biased against the writing utensil portion 25 when in a closed position. Thus, on the withdrawal of tab 19 from opening 32 as described above, writing utensil portion 25 is propelled outwardly where it may be manually pivoted about its axis 31 to a locked open position with tab 29 secured within latch opening 30.

In the embodiment of the invention featuring a nail file 110, shown in FIG. 8 the operative portion comprises a blade member 125 having a grated surface 124 for filing nails. A spoon-shaped portion 126 is formed at the outer tip of the blade member 125 for cleaning under fingernails and the like. The blade member 125 is secured in the open position by tab 129 in locking opening 130 in backplate 137. By lifting backplate 137, tab 129 may slip out of opening 130 to allow the blade member to pivot about axis 131 to the closed position of FIG. 9. In the closed position lock button assembly 115 retains the blade member 125 in the closed position by the insertion of tab 119 into depression 132 in the blade member 125. Depression of the button 115 causes the propulsion of the blade member 125 to the open position in the same manner as described in connection with the novelty pen 10 of FIGS. 1–7.

In the embodiment of the invention featuring a pair of scissors 210, the operative portion 225 of the novelty apparatus comprises a pair of scissor blades 226 and 227 and are pivotally connected in a manner known in the art. One of the scissor blades 227 is pivotally connected at an inner end at 231 to the handle portion. The scissors portion 225 is secured in the open position of FIG. 10 by the insertion of tab 229 in opening 230 of backplate 237. By lifting backplate 237, as in the other embodiments the scissors portion 235 may be released from the open position and moved about pivotal connection 231 to the closed position shown in FIG. 11. The scissors portion 235 is retained in the closed position by the insertion of tab 219 in depression 232, being actuable to the open position by button assembly 215 in a manner similar to that described above for the pen and nail file apparatus of FIGS. 1–9.

The embodiment of the invention 310 which utilizes a pair of tweezers as its operative portion 235 comprises substantially the same structure as that described above. Two jaw elements 326 and 327 are hingedly connected with the outer engaging portion of each being biased together. One jaw element is a base member pivotally connected at 331 to the handle portion so that it might move to the closed position of FIG. 13. The tweezers may be locked in the open position by tab 329 in opening 330, and released from the locked position by lifting backplate 337 over tab 329 and pivoting the tweezer portion to the closed position where button assembly 315 releasably locks it in place by the insertion of tab 319 in depression 332, substantially as described in the pen, nail file, and scissors embodiment.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A tool accessory, comprising an operative member and a handle portion, said operative member having opposing first and second ends, said first end having a utensil portion, said second end being pivotally attached to said handle portion at a point thereon, said handle portion having a recess, a first and second locking means, and an ejector means, said operative member being movable from an open position to a closed position within said recess, said first locking means including a back plate of limited resiliency tightly fastened to said handle portion, said back plate having an opening on an end portion adjacent the pivotal attachment point of said operative member to said handle portion, said operative member having an extension means engageable with said opening when in the open position, said back plate end portion being continuously biased against said extension means when in the open position for retention of said operative member in said open position, said end portion being movable for release of said extension means to allow movement of said operative member to a closed position and said operative member being releaseably engageable with said second locking means in said closed position for retention of said operative member in said closed position, said ejector means forcing said operative member from said closed position upon the release of said second locking means whereby said operative member portion may be secured in said open position for use.

2. The tool accessory of claim 1 wherein each of said first and second locking means automatically retain said operative member in said open and closed positions respectively upon movement of said operative member to said respective positions.

3. The tool accessory of claim 1 wherein said second locking means comprises a second tab mounted on said handle portion for movement into and out of said recess for releasable engagement with a retaining means formed in said operative member for locking said operative member in the closed position.

4. The tool accessory of claim 1 wherein said operative member comprises a writing means.

5. The tool accessory of claim 4 wherein said utensil portion comprises a pen.

6. The tool accessory of claim 1 wherein said operative member comprises a nail file.

7. The tool accessory of claim 1 wherein said operative member comprises a pair of scissors.

8. The tool accessory of claim 1 wherein said operative member comprises tweezers.

* * * * *